United States Patent [19]

Roth et al.

[11] Patent Number: 5,029,701

[45] Date of Patent: Jul. 9, 1991

[54] MEDICINE DISPENSER INSERT FOR NURSING BOTTLES

[76] Inventors: Lori A. Roth; David J. Roth, both of 2164 Fallen Timbers Dr.; Debra A. Schwanger; Daniel J. Schwanger, both of 514 46th St., all of Sandusky, Ohio 44870

[21] Appl. No.: 519,868

[22] Filed: May 7, 1990

[51] Int. Cl.[5] ..... A61J 7/00; A61J 9/00; B65D 71/00

[52] U.S. Cl. ..... 206/232; 206/223; 206/229; 215/6; 215/11.1

[58] Field of Search ..... 215/6, 11.1–11.6, 215/DIG. 3; 220/23; 206/538, 232, 229; 606/234–236; D24/47, 46; 128/77

[56] References Cited

U.S. PATENT DOCUMENTS

| | | | |
|---|---|---|---|
| D. 269,906 | 7/1983 | Cerasari | D24/47 |
| 1,918,307 | 7/1933 | Webber | 215/11.6 X |
| 2,048,219 | 7/1936 | Putter | 215/DIG. 3 X |
| 2,612,165 | 9/1952 | Szuderski | 606/236 |
| 2,615,448 | 10/1952 | Fields | 220/23 X |
| 2,655,279 | 10/1953 | Wolf | 215/11.1 X |
| 2,680,441 | 6/1954 | Krammer | 215/11.1 X |
| 3,077,279 | 2/1963 | Mitchell | 215/11.1 |
| 3,411,648 | 11/1968 | Tichy | 215/11.4 |
| 3,426,755 | 2/1969 | Clegg | 215/11.1 X |
| 3,458,076 | 7/1969 | Babcock | 215/6 |
| 3,645,413 | 2/1972 | Mitchell | 215/11.1 |
| 3,682,344 | 8/1972 | Lopez | 215/6 X |
| 4,776,972 | 10/1988 | Barrett | 215/6 X |
| 4,821,895 | 4/1989 | Roskilly | 215/11.1 |
| 4,856,995 | 8/1989 | Wagner | 215/11.1 X |
| 4,915,242 | 4/1990 | Marte | 215/11.1 |

FOREIGN PATENT DOCUMENTS

| | | | |
|---|---|---|---|
| 637934 | 3/1962 | Canada | 215/11.1 |
| 1129858 | 1/1957 | France | 215/11.1 |
| 962002 | 6/1964 | United Kingdom | 215/11.1 |

*Primary Examiner*—Sue A. Weaver
*Attorney, Agent, or Firm*—Paul F. Stutz

[57] ABSTRACT

Dispenser kit for infants, which comprises a vial, optionally featuring specially contoured upper end and, (1) either of a pair of annular, resilient adapter/gaskets, or different size, snugly surrounding said upper end, or (2) an integral disk-like segment extending outwardly, either (1) or (2), serving to permit vial insertion into and location within any one of several standard, but different sized, nursing bottles, each having an associated, but threadingly, attachable and removable ring-cap/nipple assembly, and providing fluid tight relationship.

14 Claims, 4 Drawing Sheets

MEDICINE DISPENSER INSERT FOR NURSING BOTTLES

INTRODUCTION/PRESENT INVENTION

The present invention relates to the dispensing of liquid ingredients, as constitutes an improvement over presently known or used techniques, and particularly as relates to infants.

The improvement contemplates the combination of a specially designed vial and/or cooperating adapter/gasket, employed with conventional or standard nursing bottles, presently marketed, for the feeding of milk and other liquids, to infants.

The feeding/dispensement of liquid ingredients to a child, or infant, or disabled, is conventionally/usually accomplished, using either a spoon or a medicine dropper.

Flailing arms, pursed lips and a moving target (the head or body), more often than not, yields poor to inconsistent, to no results.

The flailing arms distribute the liquid medicine anywhere but the targeted mouth.

Pursed lips result in liquid medicine running down the chin, throat and over the clothing and person of the parent, nurse, etc.

A moving target (the head), also yields unsatisfactory results, and possibly dangerous, results.

While the spoon and medicine dropper are carefully graduated to accomodate the precise amount/dosage of medicine, which is particularly important, respecting a young person, an infant, or a baby; the inconsistent results, as noted above, usually means that, the amount actually introduced is questionable and of course, the medicines intended result is also called into question.

It is, and can be critically important, that the amount-/dosage of a particularly medicine or ingredient, be quite precisely accurate.

A first attempt may result in some medicine being, introduced, but the precise amount is unknown, so that a repeated attempt may still result in an under dose or an over dose, either of which is unsatisfactory and could be dangerous.

For the extremely young, both the measuring spoon and the medicine dropper, are foreign to the infant, as used so infrequently, corresponding to the spaced periods of the inflamation or the disease or other infirmity, requiring medication.

Spoons and medicine droppers can also cause injury or damage to the infant. Both of these implements are solid and capable of causing a bruise, as well as, scratch damage to the face or head or an eye, and even the arms and hands.

The medicine dropper, having a pointed end, can cause puncture wounds, or in a severe case, could cause eye, nose, mouth or throat damage.

PRIOR ART

Previous efforts, relevant to those of applicant, as outlined hereinabove, have been inquired into/explored, and, as a result, three patents dealing with nursing bottles have been found, namely; Wolf U.S. Pat. No. 2,655,279; Krammer U.S. Pat. No. 2,680,441; and Roskilly U.S. Pat. No. 4,821,895. The Wolf patent, while relating to nursing appliances and disclosing a hollow tube and perforate disk, is otherwise foreign to applicants purposes and solutions; as Wolf wishes to eliminate the presence of air in the nipple of a nursing bottle and eliminate the infants taking in of air and the consequent distress caused thereby. The nursing bottle disclosed in the Krammer patent contemplates an attachment, in the form of an exteriorly located, conventional graduated, medicine or liquid dropper, secured to the bottle and connected by, tube to the nipple and, in fact, passing through the nipple sidewall and therebeyond.

The nursing bottle disclosed in Roskilly U.S. Pat. No. 4,821,895, employs an accesory, in the form of a barrel syringe, firmly affixed to an offset, threaded socket, matching the bottle, and accomodating the syringe positioned clumsily and exteriorly, of the nursing bottle.

These PRIOR ART devices have not been found in the market place and are deemed inappropriate, inferior and structurally and functionally, different from applicants unique combination of elements as described in the present specification.

OBJECTS OF THE PRESENT INVENTION

It is an object of the present invention to, provide a novel dispenser for medicine, particularly for infants, which overcomes or prevents the above enumerated difficulties, problems, injuries and the inconsistent, if not failed, results.

It is a particular object of the present invention to, provide a medicine dispenser, which utilizes a conventional nursing nipple/bottle assembly and is thus familiar to the infant, and, as well, soft and pliable and therefore, not likely capable of inflicting, or imparting, injury or damage to the infant or child, as in the case of solid spoons and/or pointed medicine droppers.

It is still another object of the present invention to, provide a dispenser, which not only utilizes the familiar nipple, but the familiar bottle/package, with which the infant is used to from feedings of milk, water, juices and other liquid products, on a daily basis, in fact multiple times daily.

It is yet another object of the present invention to, provide a dispenser, which is of universal or, at least dual, character, in that the dispenser employs (at the present time), several of the standard bottles employed as nursing bottles in the United States and elsewhere.

One of these bottles is known as the "Even Flo", another is known as the "Playtex", while a third type is known as a "Gerber" bottle. The quoted names identify the company/manufacturer, or corporate, identity.

The "Even Flo" and "Gerber" bottles are nominally designed to contain liquid within it, and dispense same through the nipple in conventional fashion.

The "Playtex" unit and the "Even Flo" disposable, are shaped like a bottle, having side walls, but are adapted to contain a sterile polyethylene bag, inserted through the open bottom end of the container and secured/compressed at the mouth, via the annular ring and nipple assembly.

It is a significant object of the present invention to, provide a dispenser vial, formed usually and preferably, of a moldable plastic, such as polyethylene, although glass is a viable alternative. The vial is rather small, such that it can be received within the conventional nursing bottle and employing, either an integral adapter/gasket, having an outer peripheral segment, securable between the nursing bottle and its corresponding nipple retaining ring; or, in the alternative, employs a novel adapter/-gasket, of annular configuration, which both support-/engages the vial and also engages with the nursing bottle.

It is yet another object of the present invention, to provide a novel combination of dispenser/vial and separate annular adapter/gasket, of utility in positioning-/locating the dispenser/vial, within the conventional nursing bottle, in the desired manner.

It is also an object of the present invention, to provide a plurality of individual, annular adapter/gaskets, designed to individually accomodate one or the other of the conventional nursing bottle assemblies, to thereby permit proper disposition of the vial, in a manner as to permit accomplishment of the purposes of the present invention.

The foregoing objects, as well as other objects of the present invention, will become apparent to those skilled in the art, from the following detailed description, taken in conjunction with the annexed sheets of drawings, on which there is presented, for purposes of illustration only, several preferred embodiments of the present invention.

DRAWING DESCRIPTION

Figure 3:
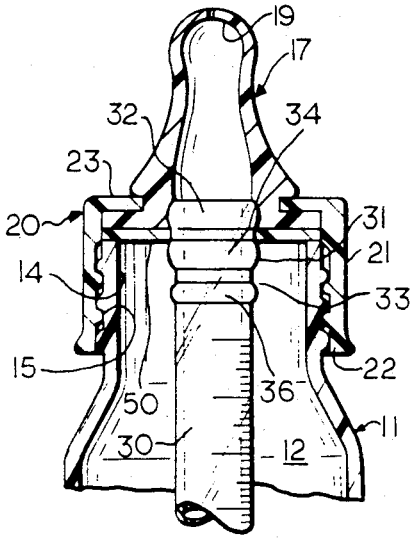
FIG. 3 is a sectional view, taken on the line 3—3, in FIG. 2.
Figure 2:
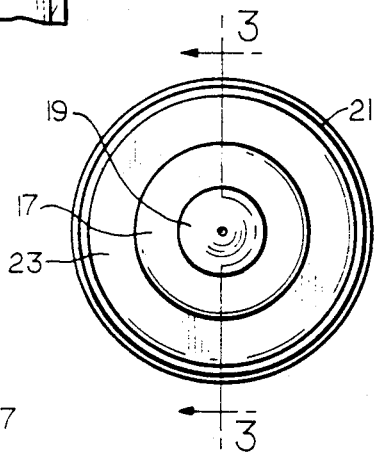
FIG. 2 is a top, plan view, of the elements shown in FIG. 3, fully assembled together in operative medicine dispensing relationship.

FIGS. 2 & 3 also illustrate the use of a standard nursing bottle manufactured by the "Evenflo Co.", but incorporating the medicine dispensing modification of the present invention.

Figure 4:
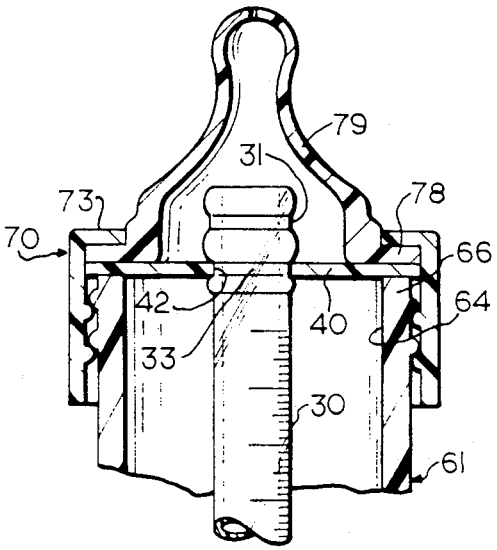

FIG. 4 is a view similar to FIG. 3, but the bottle being the "Even Flo" disposable type of nursing bottle, which employs a disposable polyethylene bag for milk in normal use. Although not shown, the bottle is open at the bottom, to permit inspection of the polyethylene bag and/or its contents.

Figure 5:
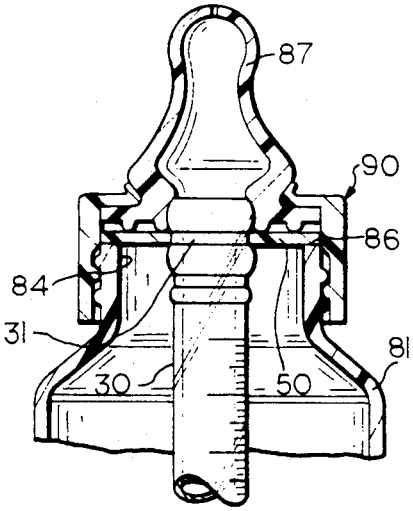

FIG. 5 is a view similar to FIG. 4, but showing the combination of a special vial and special adapter/gasket, in accordance with the present invention, with a standard nursing bottle manufactured by the "Gerber" Co.

Figure 6:
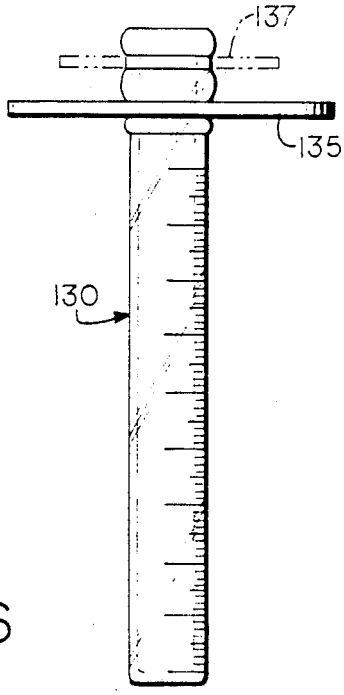

FIG. 6 is a side elevation view, of a special vial and serving to illustrate an alternative embodiment, wherein the adapter/gasket feature is integrally a part of the vial, rather than a separate annular adapter/gasket, as in the other views.

Figure 7:
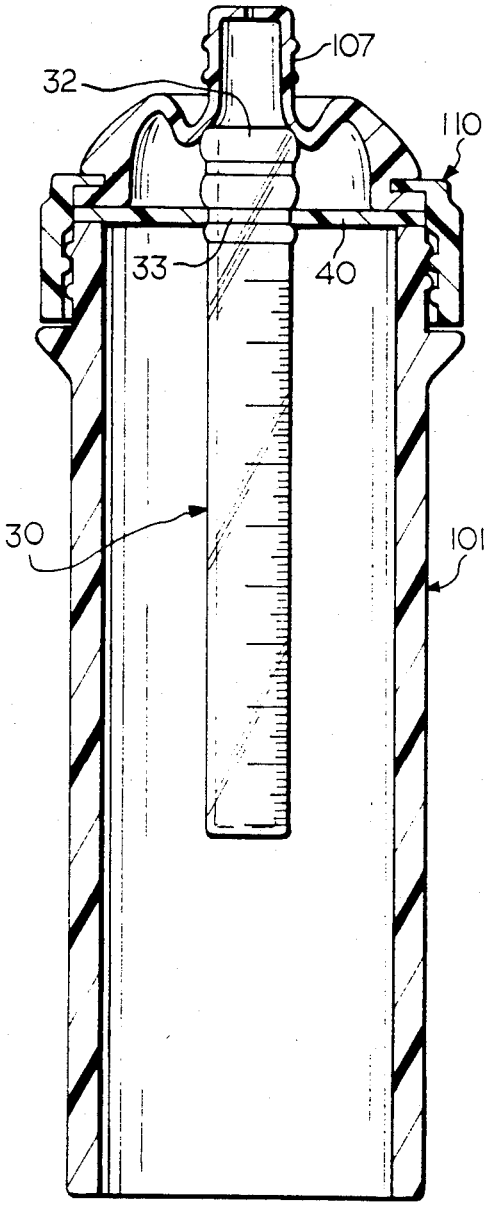

FIG. 7 is a partially side elevation, partially side, sectional view, of an assembly of parts inclusive of a "Playtex" nursing bottle, nipple and retainer ring, but incorporating a vial and adapter/gasket, in accordance with the present invention, to convert the "Playtex" nursing bottle to a medicine dispenser. This bottle is also like the "Even Flo" disposable, that is having no bottom wall to permit viewing of polyethylene bag or its contents in normal milk-dispensing use.

Figure 8:
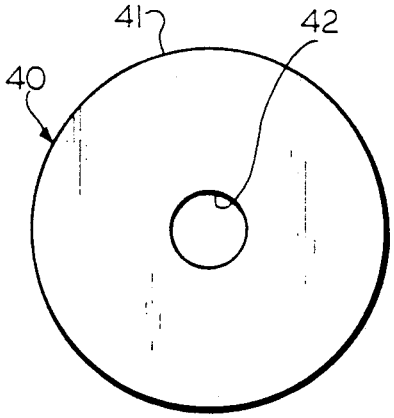

FIG. 8 is a plan view, of an annular adapter/gasket, suitable for conventional nursing bottles, having the larger mouth or rim, eg. the "Playtex" and the "Even Flo" disposable, of FIG. 4.

Figure 9:
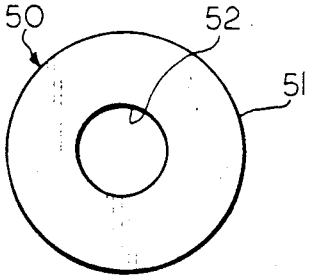

FIG. 9 is a view similar to FIG. 7, to that of FIG. 8, but showing a variant adapter/gasket, suitable for the nursing bottles having the smaller mouth, eg. smaller diameter rim, eg. the standard "Even Flo" of FIG. 3 and the "Gerber" of FIG. 5.

Figure 10:
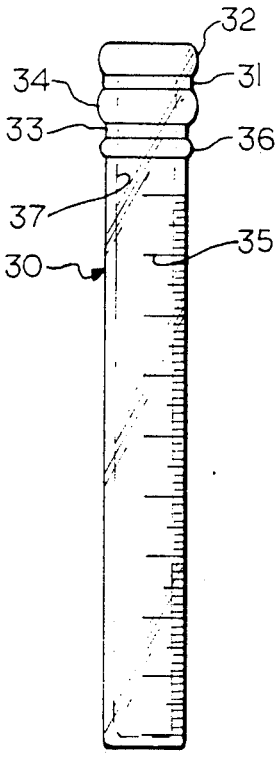

FIG. 10 is a side elevation view of the vial component of the present invention used with one or the other of the adapter/gaskets, of FIGS. 8 or 9, and serving to illustrate its hollow interior, for containing precise amounts of the desired medicine and graduations assisting same volumetrically.

Figure 11:
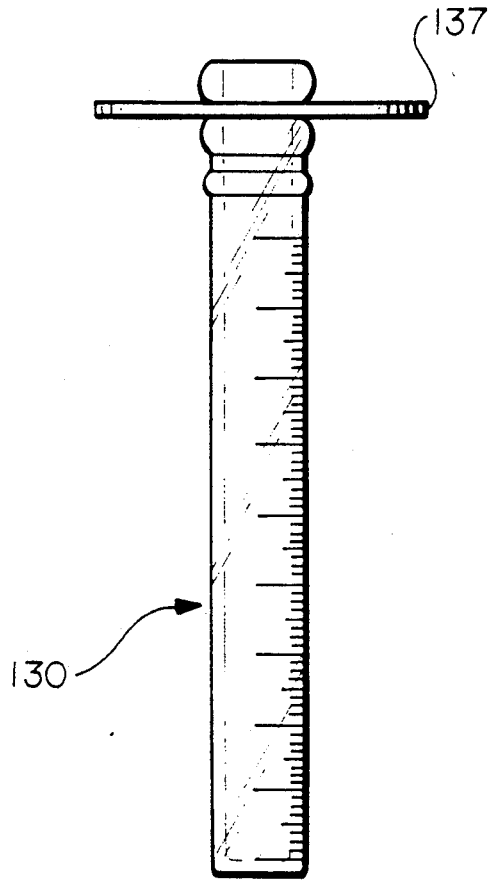

FIG. 11 is a side elevation view, like FIG. 6 and serving to illustrate a further alternative embodiment, wherein the adaptor/gasket feature is integrally a part of the vial, rather than a separate annular adaptor/gasket, as in the other view.

Figure 12:
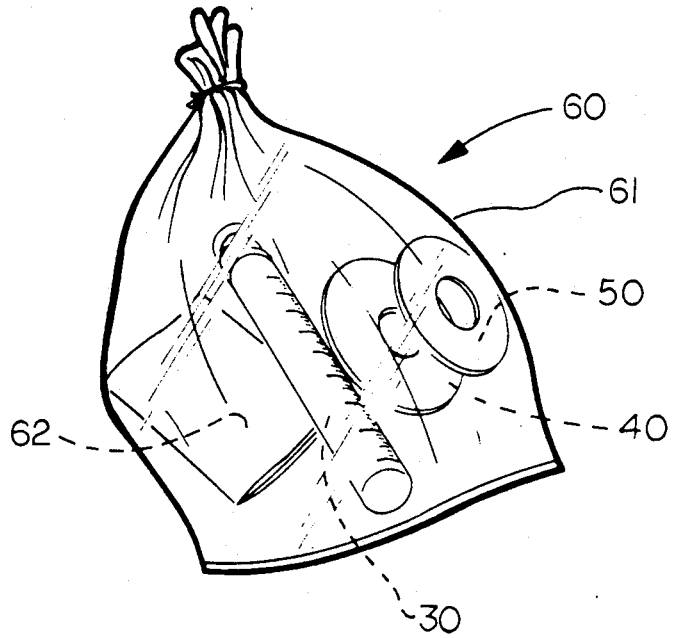

FIG. 12 is a perspective view of the embodiment of claims 11 and 12.

BRIEF DESCRIPTION OF THE INVENTION

The present invention resides, specifically, in the use of a relatively small cylindrical vial, which can be marked with graduations providing a high degree of accuracy, as to liquid volume, said vial being construed/designed/formed, to have a particularly contoured upper end, near the opening and as so contoured, be adapted for sealing engagement with a specially designed adapter/gasket, dimensioned to fit a particular bottle size, and, thereby provide sealing engagement between the bottle and the gasket and between the gasket and the vial. The adapter/gasket is first telescoped onto the vial and located at the upper end. Then this assembly is inserted into the bottle through its mouth, followed by the conventional nipple and annular closure ring, with threaded engagement between the ring and bottle as per usual. Before assembly of all of the component parts, as described, a precise amount, or dosage, of medicine or other liquid, is introduced into the graduated vial/receptacle (which is open ended). When the bottle is then inverted the contents of the vial exit the top open end of the vial and flow into the nipple, from which the medicine is dispensed through the nipple openings into the mouth of the infant or child. In an alternative structure, the vial includes an integrally formed disk like segment, which serves, in the same fashion, as the adapter/gasket member, which is separate from the vial.

DETAILED DESCRIPTION OF THE INVENTION

First, we will describe a standard nursing bottle.

Figure 1:
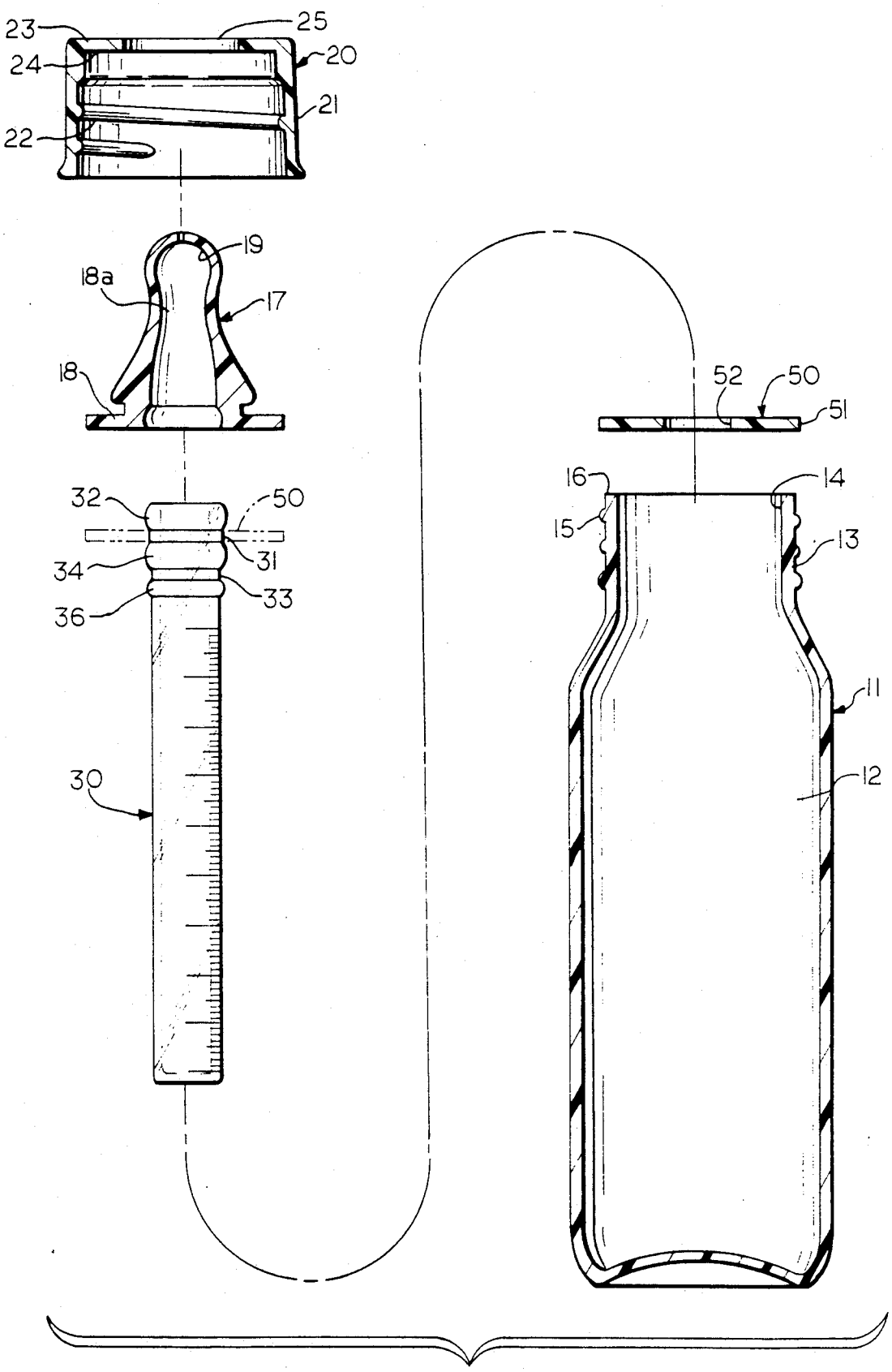
FIG. 1 is an exploded, side elevation view, partially in section, showing a conventional nursing bottle, nipple and ring retainer marketed by the "Evenflo Co.", schematically illustrating the combination of the special, novel vial and adapter/gasket of the invention and showing the manner of incorporating the latter into the former.

In FIG. 1 a standard "Even Flo" nursing bottle 11, includes a hollow interior 12, and a connected upstanding neck 13, defining a mouth 14, exterior threads 15, and an annular rim 16. The standard associated nipple 17, includes an annular base flange 18, adapted to flushly engage the bottle rim 16, a hollow interior **18*a*, and a perforate bulbous end 19**, suitable to the infants satisfaction.

The standard corresponding ring 20, features a depending annular skirt 21, featuring inner threads 22, engagable with the threads 15, of bottle 11, and an upper, inwardly turned flange 23, having an annular underside 24, which compresses the nipple flange 18, against the rim 16, of the bottle 11, to prevent leakage. The ring flange 23, encircles a circular opening 25, which passes over the nipple, as the ring 20, threadingly engages the bottle 11, and serves to center and hold the nipple and the assembly together in liquid dispensing relationship, for dispensing milk, juice, or other fluid previously located in the interior 12, of the bottle 11, and thence dispensable upon inversion of the bottle 11, and insertion of the nipple into the mouth of the baby or infant, wherein the usual and expected dispensment of the fluid, occurs, passing from bottle interior 12, through the mouth 14, into the interior 18*a*, of the nipple and thence out the perforation and into the mouth of the infant. FIG. 3 shows the assembled relationship of the parts shown exploded in FIG. 1.

In accordance with one embodiment of the present invention, we have designed a novel vial 30, and associated adapter/gasket 50. The adapter/gasket 50, is circular and has an outer periphery 51, generally congruent to the shape of the rim 16, and an inner aperture 52, capable of receiving the vial 30, as inserted down through the aperture 52, of the adapter/gasket 50, and axially projecting through the mouth down into the interior of the bottle 11, until the adapter/gasket 50, rests on rim 16, of the bottle 11, and with the aperture 52, seated in groove 31, of vial 30. In this connection, the adapter/gasket 50, is shown in dotted outline in surrounding engagement with the vial 30, seated in groove 31, of the vial. As so situate, the nipple 17, may then be placed with the flange portion overlying the adapter/gasket 50, whereupon the annular retainer ring 20, is telescoped down over the nipple 17, while it threadingly engages the neck portion of the container to yield the structure, the upper portion of which assembly is shown in FIG. 3.

Reference shall now be made to FIG. 10 for a side elevation view of the vial 30, in somewhat more detail. The vial 30, is cylindrical with a hollow interior 37, and includes an outer surface, bearing spaced graduation markings 35, calibrated to particular volumes associated with volumetric dosages of liquid medicine. The exterior upper end of the vial 30, is contoured to define three beads 32, 34 and 36, in downwardly spaced relationship, to further define an upper groove 31, and a lower groove 33, somewhat smaller in circumference than the groove 31. The uniquely defined, or contoured vial 30, and specifically the dimension of the grooves, is selected to match the size of the circular aperture, in either of the adapter/gaskets 40 and/or 50, (see FIGS. 8 and 9). As can be appreciated; upon inspection, the gasket 50, with the larger central aperture 52, is suited for seating in the upper, larger groove 31; while the adapter/gasket 40, having the smaller aperture 42, is adapted for seating in the lower groove 33, of vial 30. Also, the gaskets 40 and 50, as can be seen, have different size, outer circumferences 41 and 51, in order to accomodate the different sized mouths of the different, relatively standard and readily market-available nursing bottles.

Thus, in accordance with a preferred embodiment of this invention, a kit, or set composed of a vial 30, an adapter/gasket 40, and an adapter/gasket 50, will enable a user to use one of the several commercially and readily available nursing bottle assemblies, and, by appropriate selection of an adapter/gasket and the vial, convert the standard nursing bottle into a medicine dispenser in accordance with the tenets and teachings of the present invention as described herein.

Referring now to FIG. 4, there is disclosed, just the upper part of the conventional "Even Flo" (disposable type) bottle 61, which features a larger mouth 64, and a larger rim 66. Accordingly, the retainer cap 70, differs as shown, from the retainer cap 20, for the regular, or standard "Even flo" bottle. By reason of the larger mouth and rim, the conversion of this standard bottle requires the adapter/gasket 40, having the larger periphery 41. At the same time, the gasket 40, has the smaller aperture 42, which will dictate its encirclement sealing relationship with the vial 30, via the smaller lower groove 33, rather than the upper groove 31. The adapter/gasket 40, as reference to FIG. 4 reveals, will seat on the rim 66, of the bottle 61, followed by the annular nipple flange 78, and thence secured by threading the retainer ring 70, on the threaded upper end of bottle 61, sufficiently that the annular flange portion 73, compresses slightly, the nipple flange 78, and the adapter/gasket 40, to create a liquid tight engagement of these parts, whereby liquid cannot escape. In a similar fashion, the adapter/gasket 40, is in fluid tight engagement, via the surface of the groove 33, and thus secure against leakage at this juncture. It will be appreciated that, liquid medicine, previously located in the vial 30, will, upon inversion of the bottle, exit into the interior of the perforate nipple 79, from which it will pass to the mouth of the infant in the usual fashion.

Referring now to FIG. 5, there is disclosed, a bottle 81, marketed by and known as the "Gerber" type bottle having a smaller mouth 84, defined by rim 86, which is smaller than the rim 66, in the embodiment of FIG. 4, and similar to that of the "Even Flo" standard bottle 11, of FIG. 3. The nipple 87, and the retainer ring 90, are appropriately sized and accordingly, dictate selection of the adapter/gasket 50, of FIG. 9, by reason of its smaller outside perimeter 51, matching the size of the mouth and rim 86, of the container 81. Correspondingly, a liquid tight relationship, between the vial, nipple and the bottle, is acheived by employing the larger or upper groove 31, whereupon the nipple 87, can be situated as shown, while the retainer ring 90, is passed over the nipple into threaded engagement, with the bottle upper end, as shown, to yield the structure as shown in FIG. 2, with the vial in fluid tight communication with the interior of the nipple 87.

Referring now to FIG. 7, there is illustrated the use of the vial 30, and adapter/gasket 40, in connection with another standard, readily available, off the shelf, baby bottle; in this case a "Playtex" bottle. This bottle 101, is wide mouthed, like the bottle 61, of FIG. 4, and features a correspondingly sized nipple 107, and retainer ring 110, and accordingly, calls for the larger adapter/gasket 40, in order that, the larger perimetric size will match the larger mouth opening, to create a fluid tight relationship, between the nipple, the adapter/gasket and the bottle. Similarly, the choice of the gasket 40, having the smaller aperture 42, will call for employment of the smaller groove 33, to create a fluid tight seal, as between the vial and the adapter/gasket 40. Otherwise, the component part of the assembly are put together in the sequence, as described in connection with the component parts of FIG. 1, to yield the structure, shown in FIG. 7, with the vial bead 32, in abuttment with the underside of the nipple, as shown, whereby liquid medicine, having been previously placed into the vial 30, will, upon inversion of the overall structure, find the liquid draining into the nipple for dispensement in the usual fashion.

Referring not to FIG. 6, there is disclosed, an alternative embodiment of the present invention, wherein the vial 130, includes a flared circular portion 135, integral with the vial 130. This one piece structure, as a variant embodiment of the present invention, thus incorporates an integral adapter/gasket, and, is thus suitable for use with the readily available nursing bottles, featuring the larger mouth opening, such as the "Playtex" and the "Even Flo" dispensing type of bottle. Alternatively, as shown in FIG. 11, the invention contemplates a one piece vial, featuring, instead of the flared circular segment 135; a somewhat smaller, circular segment 137, having an outside diameter matching the size of the smaller mouthed standard baby bottles, such as the "Even Flo" standard and the "Gerber" bottle. Reference numeral 137, identifies in FIG. 11 the smaller circular segment. The vial, as shown in FIG. 6 and FIG. 11, discloses the beads as in FIG. 10, but such may not be necessary in this embodiment where the adapter/gasket is integrally a part of the vial, as formed.

As previously indicated, in accordance with one embodiment of the present invention, it is contemplated that, a vial, as disclosed and described herein, and with particularity in FIG. 10, and one of each of the gaskets 40 and 50, shown in FIGS. 8 and 9, would be assembled as a three component kit 60, perhaps marketed in a transparent, plastic container 61, or via the "blister-pak technique", frequently displayed in retail outlets. These outlets and others carry the standard size, nursing bottles, as identified and illustrated herein. The kit package would include illustrative sketches and directions, outlining the adaptability and universality of the kit, including dual functionality of the specially contoured vial, and matching adapter/gaskets, for use with the standard and available bottles. It is likewise envisioned that the kit would be identified by an appropriate tradename or a trademark selected to alert and inform the viewer/shopper of the utility of the kit, as a medicine dispenser for infants, utilizing readily available or owned nursing bottles.

The selection of particular materials of construction and/or fabrication, for the vial or the adapter/gasket, does not form or constitute a part of the present invention. Baby nursing bottles are known to be fabricated of glass, or of plastic, usually polyethylene, having desired physical and chemical properties to meet conditions to be met in use in cleaning. The vial component of the present invention, may similarily be fabricated of polyethylene, or similar plastic, or glass. From the standpoint of cost of manufacture, the polyethylene would likely be preferred, since the kit featuring a vial formed of polyethylene could be produced and marketed for sale at a lower cost to the consumer. It would be desirable, of course, that the vial be formulated to be, either transparent or extremely translucent, in order that, the amount of liquid introduced can be conveniently measured, using the graduations provided.

The adapter/gaskets likewise, can be fabricated of plastic, usually polyethylene, or of a similar plastic, and of such composition as to have, at least sufficient compressability, as to be adapted to form a liquid tight seal, with the rim and the nipple flange, and also with the groove formed in the vial, so that, medicine in the vial, dispensed into the nipple, is confined to the nipple, such that it cannot leak or drain back into the bottle or outside of the bottle, either through any leaks at the rim or at the juncture of the vial groove, and the adapter/gasket member. This is important in order that, the precise dosage, in volume, is transmitted or conveyed from the vial, to the nipple and thence to the child or infant.

The dispensement of medicine, in accordance with and/or possible, by reason of the present invention and its component parts, as disclosed herein, is seen as peculiarly desirable and advantageous, since the dispenser is, in fact, a nursing bottle, with which the child is already familiar. The medicine in the vial is not readily observed by the child, because of its recessed location, on the inside of the bottle. Yet the precise dosage of medicine is readily and accurately deliverable to the nipple, as it is placed proximate, or within the child or infants mouth, who will begin the usual sucking action immediately, by reason of the familiarity of the overall appearance, and, as well its tactile familiarity, both to the hands and to the mouth of the child or infant. Spillage is completely avoided, such that the dosage amount is insured. Further, damage or injury is obviated by the absence of medicine dropper, and/or spoon administered medication.

Other and further obvious modifications, changes and variants, will become apparent to those skilled in the art, by reason of the foregoing description, and accordingly, it is intended to include all such obvious modifications and variants within the scope of this invention, unless to do so would be violative of the language of the appended claims.

We claim:

1. A liquid ingredient dispenser, comprising a conventional nursing bottle assembly, inclusive of a bottle, a nipple and retainer ring, a graduated vial for liquid ingredient, dimensioned to fit completely within said bottle and said nipple, and means surrounding said graduated vial, constructed, arranged and dimensioned to fluidly isolate said vial from said bottle, and providing for dispensement of a precise dosage of liquid ingredient within said vial, to the interior of said nipple, when said nursing bottle is inverted.

2. A bottle assembly, inclusive of a bottle, with a threaded, rim-defined, open mouth, a rubber like nipple having a flared flange adapted to abut said rim, and an annular, threaded retainer-ring for securing said nipple flange, in releasable fluid tight and dispensing relationship with said bottle, and, in combination therewith;

a cylindrical vial open at one end, dimensioned to fit axially within said bottle through said mouth, said vial including an integral, annular flange, dimensioned to abut said rim, as said nipple and retainer-ring are threadingly assembled onto said bottle, said open-end of said vial projecting upwardly, proximate said nipple interior, whereby liquid medicine, within said vial, is introduced into said nipple as the bottle is inverted, for dispensement, via said nipple.

3. The invention, as claimed in claim 2, wherein said integral annular flange is instead a separate annular gasket, having an inner periphery constructed, arranged and dimensioned for fluid tight engagement with said outer surface of said vial, and an outer periphery, corresponding to the size of the rim.

4. The invention, as claimed in claim 3, wherein said vial includes two outer grooves dimensioned for seating either, of, two annular gaskets, having different sized inside diameters.

5. The invention, as claimed in claim 4, wherein said grooves are spaced apart near the upper, open end and the upper groove defines a circumference, larger than the lower groove.

6. The invention, as claimed in claim 4, wherein said annular gaskets have different sized outside diameters, to accomodate different sized baby bottles.

7. An accessory for converting a conventional nursing bottle, nipple and retainer-ring assembly, into a liquid ingredient dispenser, comprising;

a vial receptacle, for liquid ingredients, constructed, arranged and dimensioned for location completely within said nursing bottle and nipple, and at least one separate, resilient annular gasket dimensioned to encircle said vial and maintain fluid tight relationship as between the vial receptacle and the bottle.

8. The invention, as claimed in claim 7, wherein said vial includes two outer grooves dimensioned for seating either, of two annular gaskets, having different sized inside diameters.

9. The invention, as claimed in claim 8, wherein said grooves are spaced apart, near the upper, open end and the upper groove defines a circumference, larger than the lower groove.

10. The invention, as claimed in claim 8, wherein said annular gaskets have different sized outside diameters, to accomodate different sized baby bottles.

11. In combination:

an open ended elongate, tubular vial, and a cooperating, resilient, annular gasket, which items are constructed, arranged and dimensioned to convert a conventional, infant nursing bottle composed of a bottle, a dispensing nipple and a retaining ring into a dispenser for liquid ingredient, said vial being small enough to fit complete within said infant nursing bottle and nipple, and being positioned by the annular gasket in surrounding, supporting and liquid tight relationship with said vial, said gasket also contacting said bottle proximate said nipple and said retainer ring, whereby upon inversion of said so formed assembly, liquid ingredient within the vial flows into said nipple for dispensement.

12. An accessory, for converting a conventional infant nursing bottle composed of a bottle, a dispensing nipple and a retaining ring into a liquid ingredient dispenser, said assembly comprising, a cylindrical elongate, tubular, open-ended vial dimensioned to fit conveniently, telescopically and completely within said bottle and nipple, with its open end proximate said nipple, and a resilient, annular gasket dimensioned to moveably surround said vial in fluid tight relationship and having an outside diameter suitable for fluid tight relationship with said bottle, said accessory and bottle, when combined, cooperating to provide, upon inversion, flow of liquid ingredient from said vial into said nipple for dispersement.

13. A kit for converting standard nursing bottle assemblies; composed of a hollow bottle, an associated nipple and associated annular retainer ring, into a medicine dispenser;

said kit comprising a vial/tubular container, sized to fit within any of said bottles, and a plurality of adapter/gaskets having different sized perimeters to accomodate different sized bottles;

and a packaging means adapted to hold and display said vial and plurality of gaskets.

14. The invention is claimed in claim 13, wherein said kit includes instructions for assembling said parts of said kit and said standard nursing bottle components, as to yield a medicine dispenser for infants.

* * * * *